US006120315A

United States Patent [19]

Gaertner et al.

[11] Patent Number: 6,120,315

[45] Date of Patent: Sep. 19, 2000

[54] TERMINAL BLOCK ASSEMBLY WITH INSULATION PENETRATING MEANS

[76] Inventors: Norbert Gaertner, Margaretenstrasse 22, 42285 Wuppertal; Klaus-Dieter Burmeister, Eibenweg 35, 42111 Wuppertal; Hans-Dieter Otto, Breslauerstrasse 1a, 51688 Wipperfürth; Wolfgang Edelmann, Magdalenenstrasse 48, 42111 Wuppertal; Michael Knoll, Starenweg 13, 33758 Scholss Holte; Stefan Lukoschek, Robert-Koch-Strasse 13, 33813 Oerlinghausen; Walter Hanning, Am langen Grund 66, 32758 Detmold, all of Germany

[21] Appl. No.: 09/245,411

[22] Filed: Feb. 5, 1999

[30] Foreign Application Priority Data

Feb. 17, 1998 [DE] Germany ..... 298 02 674 U

[51] Int. Cl.[7] ..... H01R 4/24

[52] U.S. Cl. ..... 439/395; 439/417

[58] Field of Search ..... 439/395, 409, 439/410, 417, 443, 396, 397, 398, 400, 401, 402, 391, 715, 716, 713, 709, 712

[56] References Cited

U.S. PATENT DOCUMENTS

| | | | |
|---|---|---|---|
| 4,340,270 | 7/1982 | Wilmes et al. | 439/409 |
| 4,466,682 | 8/1984 | Jusseau et al. | 439/391 |
| 5,620,332 | 4/1997 | Gerke et al. | 439/417 |
| 5,622,517 | 4/1997 | Heng et al. | 439/417 |

FOREIGN PATENT DOCUMENTS 2516711 3/1985 France .

*Primary Examiner*—Paula Bradley
*Assistant Examiner*—Ross Gushi
*Attorney, Agent, or Firm*—Laubscher & Laubscher

[57] ABSTRACT

A terminal block assembly is provided containing a bus bar having a knife edge arranged to penetrate the insulation of an insulated conductor that is carried by a support member, whereby during the connection of the support member with the terminal block, the insulation is penetrated by the knife edge to electrically connect the conductor with the bus bar. In order to facilitate the connection of the support member to the terminal block, the support member and the terminal block are provided with openings that cooperate to define a long-arm pivotal leverage arrangement that provides an assembling tool with a mechanical advantage for assisting in the penetration of the insulation by the knife edge.

13 Claims, 5 Drawing Sheets

TERMINAL BLOCK ASSEMBLY WITH INSULATION PENETRATING MEANS

BACKGROUND OF THE INVENTION

1. Field of the Invention

This invention relates to a terminal block assembly including a terminal block member having a bus bar provided with knife edge means for penetrating the insulation of an insulated conductor that is carried by a support member, whereby during the connection of the conductor support member with the terminal block member, the insulation layer is penetrated by the knife edge to effect an electrical connection between the bus bar and the conductor. In order to provide a mechanical advantage during the connection of the conductor support member with the terminal block member, the support member and the terminal block member are provided with associated openings that cooperate to define a long-arm lever arrangement affording a mechanical advantage to assist in connecting the members together.

2. Brief Description of the Prior Art

As disclosed, for example, by the French patent No. 2,516,711, it is known in the patented prior art to provide a contact activation piece having catch surfaces for the insulated conductor and that can be shifted within the interior of the insulation material housing of the terminal block between conductor insertion position and a contacting position in which the conductor is pressed into engagement with the displacement contact that penetrates the conductor insulation. In the insulation material housing that is closed off upward, there is an insertion opening for the conductor, which is adjoined by guide means that extend all the way into the area over the displacement contact, and furthermore, there is provided a wide, essentially V-shaped passage and support opening for a tool, for example, a screwdriver, that is operable to shift the contact activation piece. Under this opening in the insulation material housing, there is arranged another insertion and support opening in the movable contact activation piece. The arrangement is so made that the contact activation piece is initially held with the tool in the conductor insertion position in which the conductor can be inserted into the contact activation piece, while the tool is supported on one of the oblique surfaces of the opening in the housing that faces toward the conductor. The tool is then turned into the opposite oblique position in the other oblique surface of the opening in the contact, and the contact activation piece is then forced with the lower end of the tool supporting the tool on the oblique surface in the upper wall of the housing exerting manual force over the displacement contact, while the conductor is contacted in an insulation-penetrating manner, with corresponding action.

In particular, in the case of conductors with larger diameters, by no means inconsiderable forces have to be supplied in this kind of insulation-penetrating contact making procedure. The previously known design here is problem-prone inasmuch as unfavorable lifting conditions result for the supply of the force required to achieve the necessary insulation-penetrating contact with the conductor. The pivotal point, so to speak, is the bracing of the tool on one limiting surface of the opening on top in the housing with a first lever arm up to the end of the tool in the contact activation piece and, with the other lever arm, above the housing, all the way to the handle of the tool. In this design, during the press-in phase, there is also an extremely unfavorable force-consuming, practically useless force component that considerably stresses the upper, thin-wall and rather unstable area of the insulation material housing.

Moreover, under these leverage conditions, the activation tool must also be impacted manually with a force component pointing downward. Nevertheless, the lower end, for example, the sharp-edged end of a screwdriver in the receiving opening of the contact activation piece, easily migrates upwardly and, after repeated activation, causes damage here. Moreover, in this design, the tool has a considerable pivot arc distance and collides in the conductor insertion position easily with the inserted conductor.

SUMMARY OF THE INVENTION

Accordingly, a primary object of the present invention is to provide a terminal block assembly including a terminal block member containing a bus bar having a knife edge, and a conductor support member adapted to carry an insulated conductor, said conductor support member being connected for displacement relative to said terminal block member between a first position in which the insulated conductor is spaced from said knife means, and a second position in which the insulation on the insulated conductor is penetrated by the knife means, thereby to electrically connect the conductor with the bus bar.

According to another object of the invention, the terminal block and conductor support members are provided with openings for receiving an assembly tool that is pivotally operable to displace the conductor support member from the first position to the second position, the openings being arranged to define a long-arm leverage effect that provides a mechanical advantage which assists in the penetration of the layer of insulation by the bus bar knife means.

According to a further object of the invention, the terminal block and conductor support members are provided with cooperating guide means that guide the members for relative displacement, stop or catch means being provided for defining said first and second relative positions of the members. A further stop arrangement prevents displacement of the conductor support member from the second position to the first position, thereby to prevent removal of the conductor support member from the terminal block member.

According to a further object of the invention, a pair of conductor support members may be provided for connection with opposite ends of the terminal block member for cooperation with knife means mounted at each end thereof.

According to a more specific object of the invention, the openings affording the leverage effect for assisting in the assembly of the components include a through opening contained in the upper part of a portion of the conductor support member that projects toward the terminal block member, and the associated other opening is a V-shaped slot contained in the bottom of an internal chamber contained in the terminal block member, the openings being so arranged that the tip of a screwdriver may be inserted through the through bore into the bottom of the slot, whereby the screwdriver may pivoted about the bottom of the slot and the entire length of the screwdriver is used to produce the desired leverage and mechanical advantage in assisting the penetration of the conductor insulation by the knife means. There are substantially no force components that unduly stress the terminal block or conductor members. The relative small controlled pivotal motion of the screwdriver is in such a direction that it will not collide with the inserted conductor when the conductor support member is in the second position electrically connecting the conductor with the bus bar.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
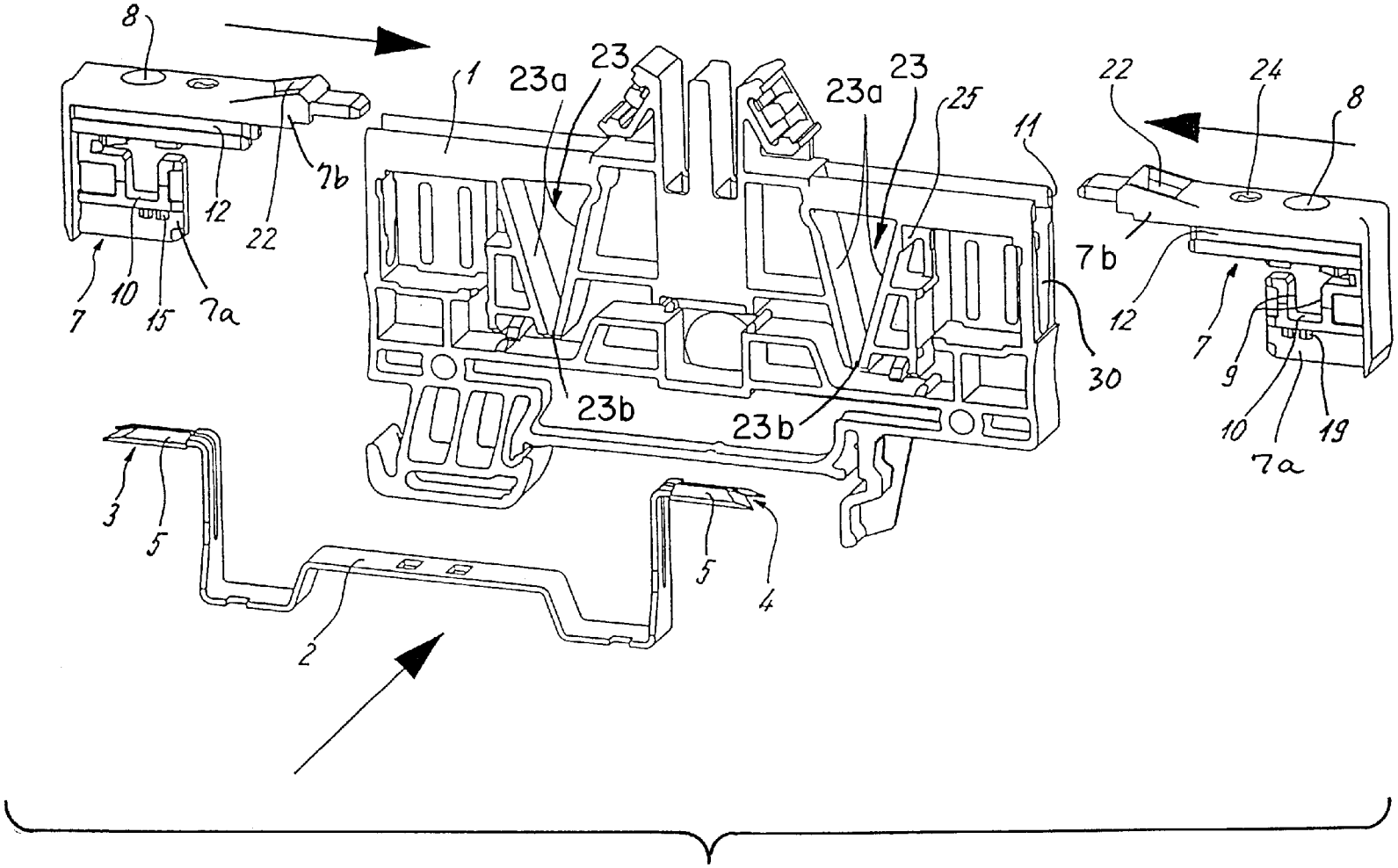
FIG. 1 is an exploded perspective view of the terminal block assembly of the present invention.
Figures 3, 3A:
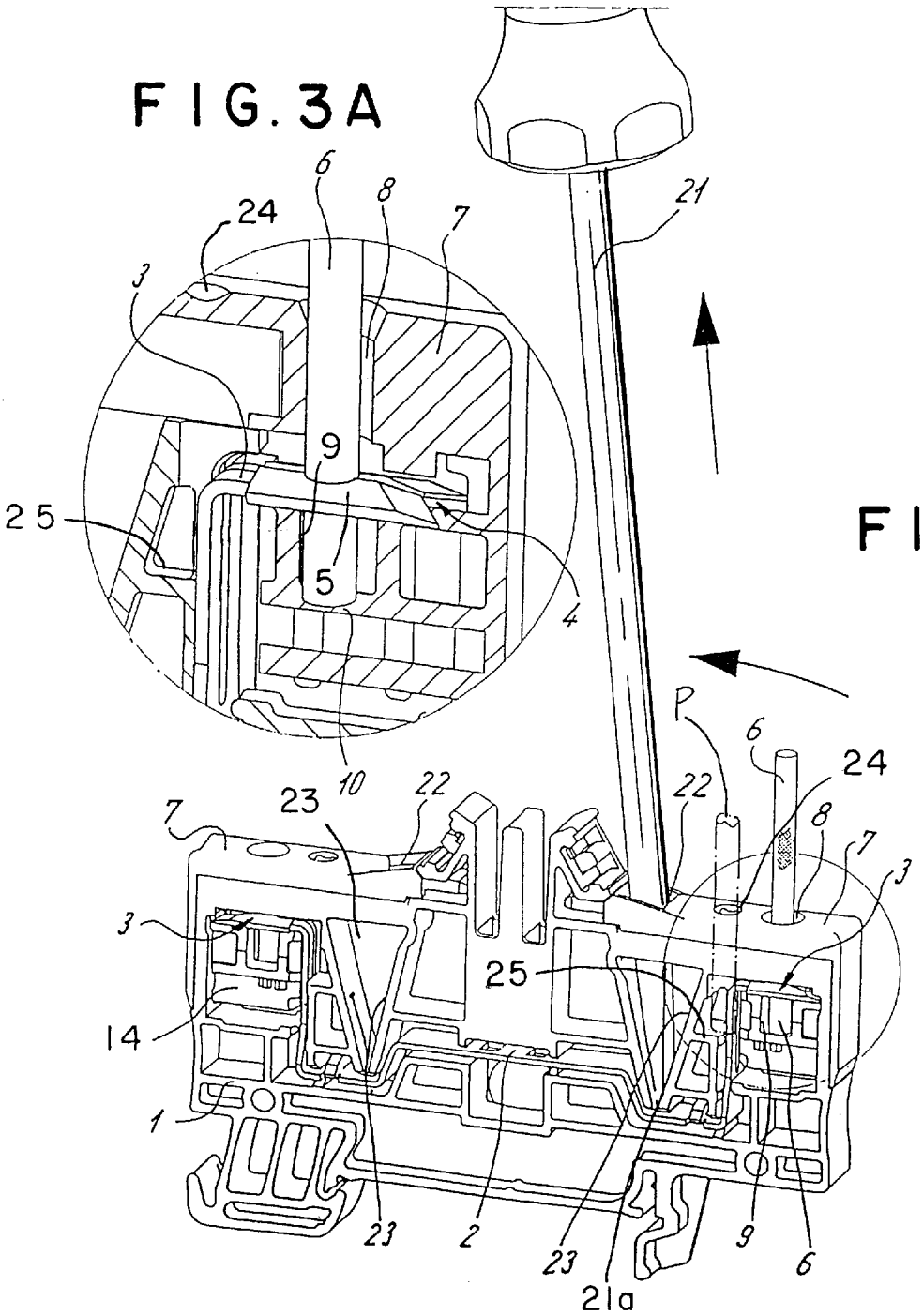
FIG. 3 is a perspective view of the assembly process with the conductor support member in the second position.
FIG. 3A is a detailed exploded view of the insulation penetrating operation of the busbar knife means of FIG. 3.
Figure 4:
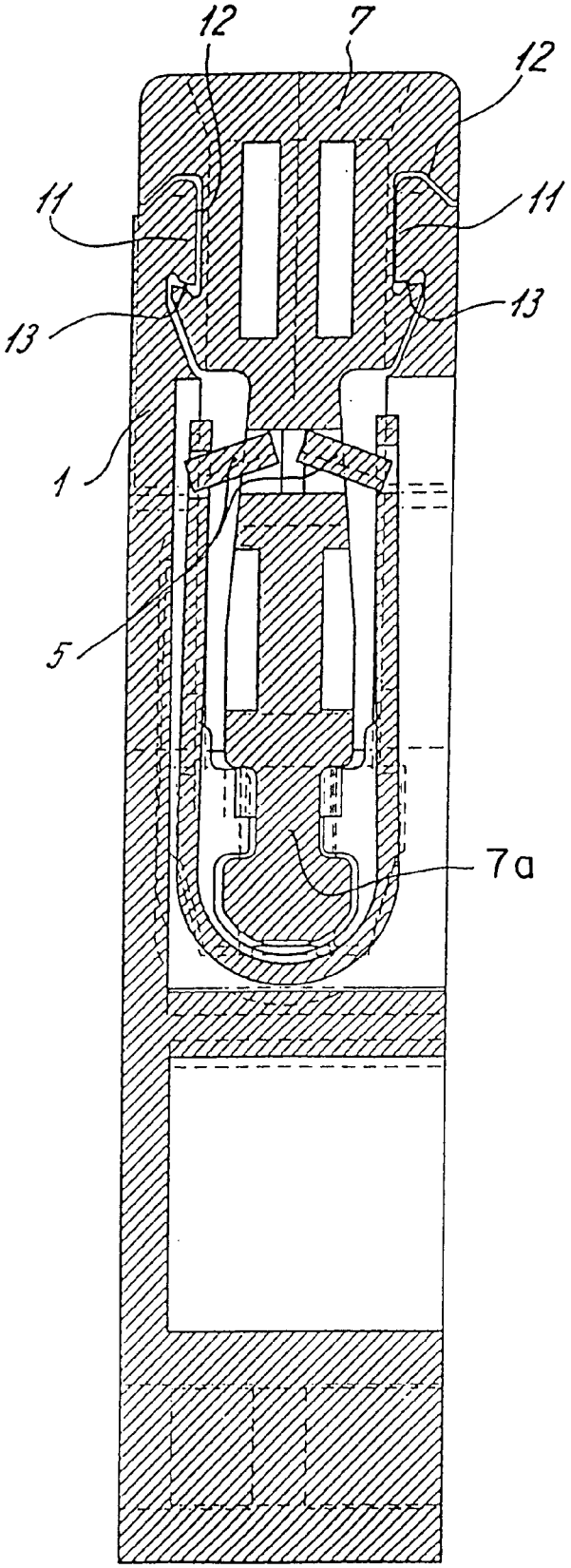
FIG. 4 is a vertical sectional view taken along line 4—4 of FIG. 3.

Referring first more particularly to FIG. 1, the terminal block member 1 of the present invention is formed of synthetic plastic electric insulating material and is provided with a recess for receiving a generally U-shaped electrically-conducting metal busbar 2 which includes at each end a pair of insulation-penetrating means 3 including resilient bifurcated knife means 5 having an entry slot 4. The terminal body member 1 includes at each end a pair of end openings 30 for slidably receiving a pair of conductor support members 7, respectively. Each conductor support member 7 contains a vertical through opening 8 that is adapted to receive an insulated conductor 6 as best shown in FIG. 3. The conductor 6 extends downwardly to the position shown in the FIG. 3A, whereupon the extremity of the insulated conductor 6 abuts the bottom wall 10 of the recess defined between the parallel spaced sidewalls 9. As shown in FIGS. 1 and 4, the conductor support members 7 are guided by dovetail guide means 11 and 12 for sliding movement within the end openings 30 contained in the opposite ends of the terminal block member 1. The under side of the rail dovetail guide means 11 includes an undercut region 13, as best shown in FIG. 4, thereby insuring that upon the application of a pulling force on the conductor 6, the associated wall areas of the dovetail guide means are such that outward yielding of these wall areas of insulation of the housing 1 will be prevented.

Figure 5:
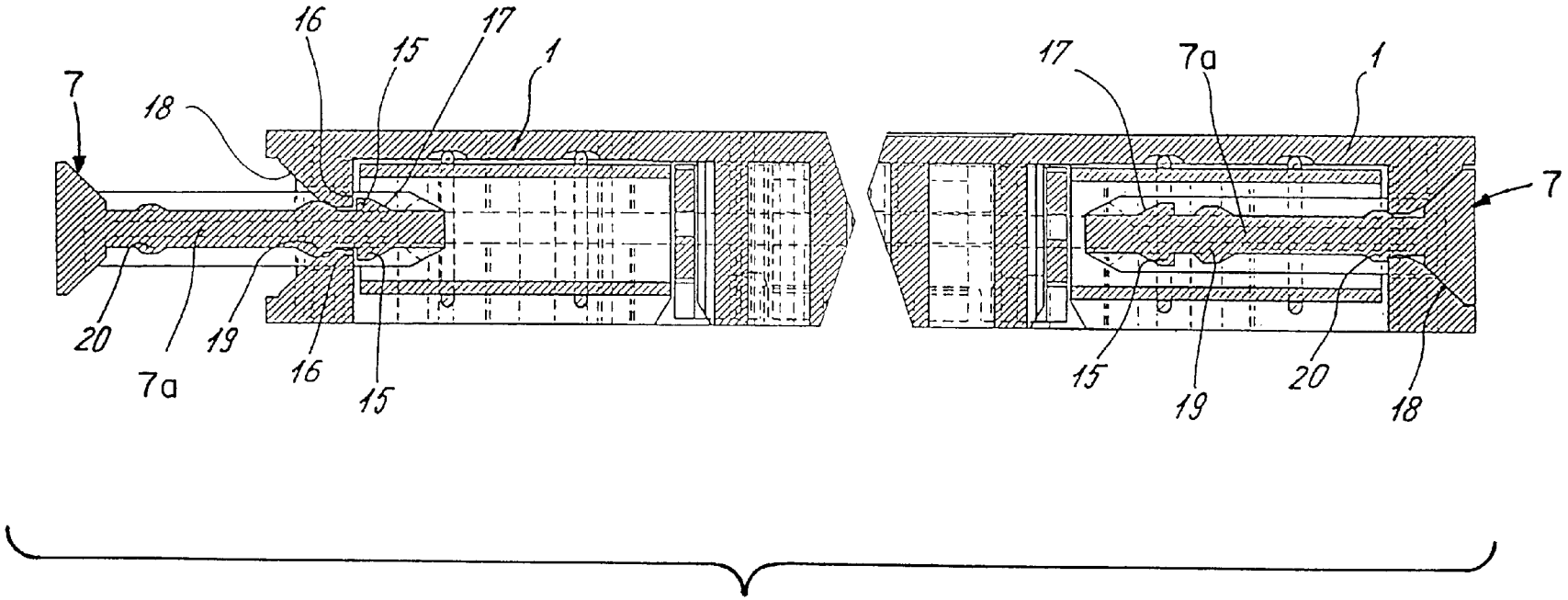
FIG. 5 is a horizontal sectional view illustrating the operation of the catch means on the conductor support and terminal block members.

After an insulated conductor 6 is inserted within a corresponding opening 8, the conductor support member 7 is slideably displaced inwardly toward the slot 4 to cause the layer of insulation on the conductor 6 to be penetrated by the bifurcated resilient knife means 5, as best shown in FIG. 3A. The body portion 7*a* of the conductor support member 7 is provided with stop shoulders 15 (FIG. 5) that cooperate with corresponding thrust bearing surfaces 16 to prevent removal of the conductor support members 7 from the terminal block body member 1. The lower body portion 7*a* also carries a pair of spaced projections 19 and 20 having inclined ramp surfaces that cooperate with the thrust bearing portions 16 to define catch means for establishing the first and second positions of FIGS. 2 and 3, respectively, of the conductor support member relative to the terminal block member 1.

Figure 2:
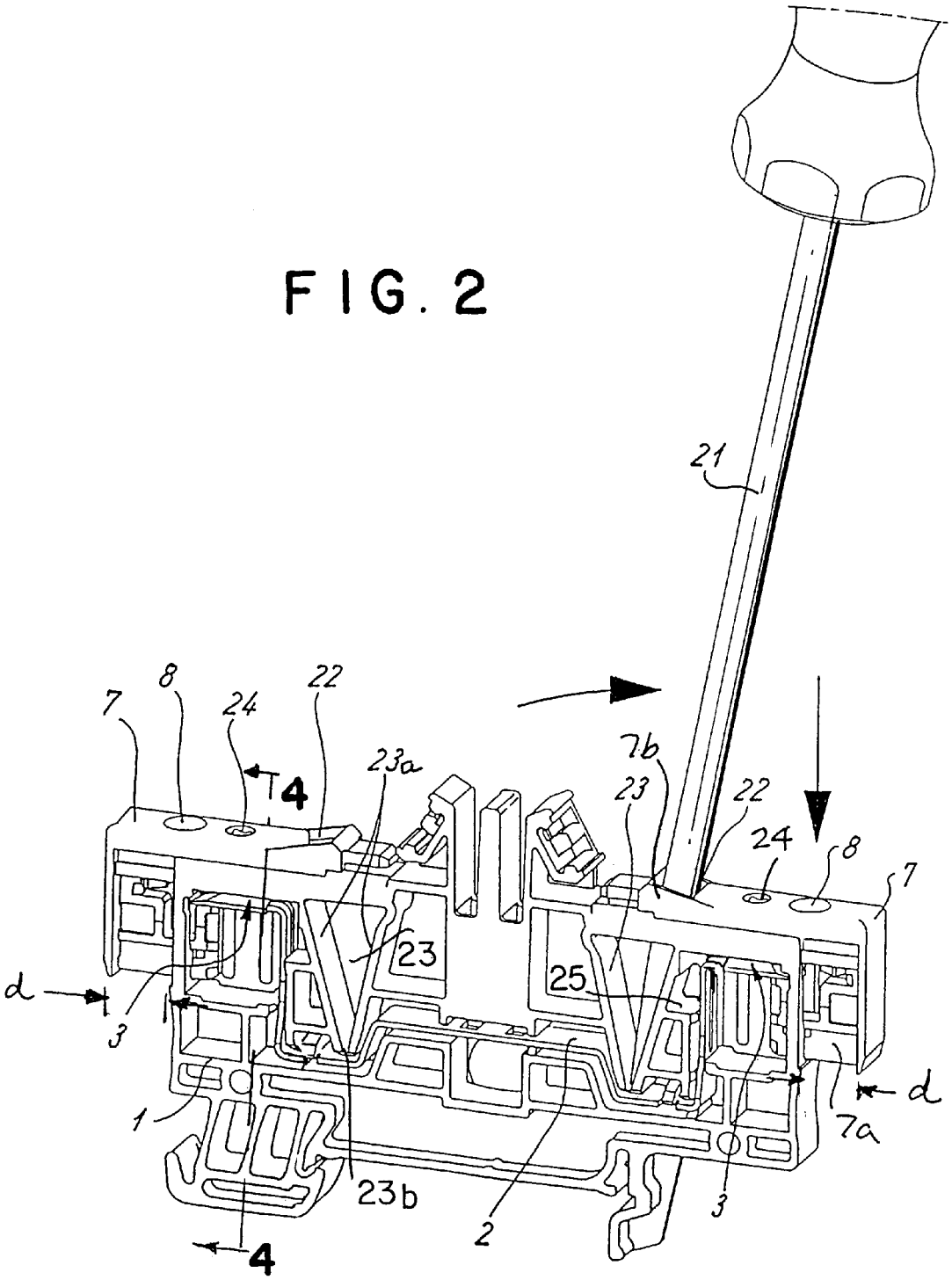
FIG. 2 is a perspective view of the assembly process with the conductor support member in the first position.

Each conductor support member 7 includes an upper projecting portion 7*b* that extends toward the center of the terminal block body 1. The projecting portions 7*b* each contain an opening 22 through which an assembling tool 21, such as a screwdriver, may be introduced. Correspondingly, the terminal block member 1 contains an associated pair of V-shaped slots 23 having downwardly converging sidewalls 23*a* that terminate at their lower extremity in a pivot point 23*b*. Thus, as shown in FIG. 2, the assembling screwdriver 21 has a tip extremity 21 a that extends downwardly into the V-shaped slot 23 until it engages the pivot point 21*a*, whereupon the screwdriver 21 is pivoted to the left in FIG. 3 to cause the conductor support member 7 to be slidably displaced from the conductor-inserting first position of FIG. 2 toward the insulation-piercing second position of FIG. 3. Since the pivot point 21 a is arranged near the bottom of the slot 23 contained in terminal block member 1, and the walls of the opening 22 are contained in the upper portion of the conductor support member 7, the long-arm leverage effect produced by the screwdriver 21 during the assembly steps of FIGS. 2 and 3 produces a mechanical advantage that is applied to the conductor supporting member 7, thereby to assist in the penetration of the layer of insulation on the conductor by the associated bifurcated resilient knife means 5. Thus, the ratio between the total length of the screwdriver and the length between the screwdriver tip 21 a and the walls of the through opening 22 provide the desired mechanical advantage. Accordingly, the force to be supplied, thanks to this arrangement of parts, prevents the stressing of the synthetic plastic materials of the terminal block and conductor support members, and also is protected against damage by the relatively sharp edge end of the screwdriver.

Since the leverage effect afforded by the cooperation of the screwdriver 21 with the opening 22 in the pivot point 21*a* is relatively long, the angular arc of pivotal movement of the screwdriver 21 is relatively small. Furthermore, the acute angle of the V-shaped slot 23 also provides a secure hold for the screwdriver, and prevents any lateral shifting motion relative to the slot 23.

Furthermore, the conductor support members 7 are provided with inspection openings 24 opposite the insulation penetrating means 3, where a test probe P (FIG. 3) may be introduced through the opening 24 into engagement with the associated upwardly extending leg portion of the busbar 2. The bottom wall surface 25 on the terminal block serves as a stop support shoulder for the probe P.

While in accordance the preferred forms and embodiments of the invention have been illustrated and described, it will be apparent to those skilled in the art that changes may be made without deviating from the invention set forth above.

What is claimed is:

1. A terminal block assembly for electrically connecting an insulated conductor to a bus bar, comprising:

(a) a generally rectangular terminal block member (1) having top, bottom, and a pair of end portions;

(b) a bus bar (2) mounted on said terminal block member, said bus bar including at least one insulation penetrating knife means (3);

(c) at least one conductor support member (7) containing a conductor bore (8) for receiving an insulated conductor (6);

(d) means connecting said support member with an end portion of said terminal block member for horizontal displacement in a direction normal to said bore from a first position in which the conductor is supported in spaced relation to said knife means toward a second position in which said knife means penetrates the conductor insulation and engages the conductor to electrically connect the conductor with said bus bar; and (e) means for displacing said conductor support member from said first position toward said second position relative to said terminal block member, including:

(1) a generally vertical tool-receiving through opening (22) contained in said support member; and (2) a tool-receiving slot (23) contained in said terminal block member, said slot and said bore being on opposite sides of said knife means when said conductor support member is in said first position, said slot and said through opening being initially spaced a given distance (d) in the direction of relative displacement of said members when said conductor support member is in said first position, said through opening and said slot being so arranged that when the extremity (21*a*) of a fastening tool (21) is inserted successively through said opening and into said slot, the bottom of said slot defines a pivot point (23*b*) adapted for engagement by the tool extremity and about which the tool may be pivoted, thereby to displace said support member from said first position toward said second position.

2. Apparatus as defined in claim 1, wherein said tool-receiving slot has a V-shaped converging cross-sectional configuration.

3. Apparatus as defined in claim 2, wherein said slot has an acute angle of convergence.

4. Apparatus as defined in claim 1, and further including guide means for guiding the conductor support member during the displacement thereof relative to said terminal block member.

5. Apparatus as defined in claim 4, wherein said terminal block member contains an end opening (30) slidably receiving said conductor support member, and further wherein said guide means comprises dovetail guide means having cooperating tongue (12) and groove (11) elements arranged on adjacent wall portions of said conductor support member and said terminal block member, respectively.

6. Apparatus as defined in claim 5, wherein said dovetail guide elements have relative undercut portions (13).

7. Apparatus as defined in claim 1, and further including first and second stop means (19, 20) for retaining said conductor support member in said first and second positions, respectively, relative to said terminal block member.

8. Apparatus as defined in claim 7, wherein said conductor support member includes a body portion (7*a*) containing said conductor-receiving bore, and an extension portion (7*b*) that extends from said body portion in the direction of said tool-receiving slot, said extension portion containing said through opening.

9. Apparatus as defined in claim 8, wherein said first and second stop means comprise first and second lateral stop projections (19, 20) arranged in spaced relation on said body portion of said conductor support member, said first and second lateral stop projections being arranged for successive cooperation with corresponding stop shoulder means (16) arranged on the adjacent wall surface of said terminal block member, said first and second lateral stop projections having inclined ramp surfaces.

10. Apparatus as defined in claim 9, and further including third lateral stop projection means (15) arranged on said conductor support member body portion, said third stop projection means and said stop shoulder means having cooperating thrust surfaces for preventing removal of said conductor support member from said terminal block member.

11. Apparatus as defined in claim 10, wherein said third lateral stop projection means is arranged adjacent the end of said conductor support member that carries said extension portion.

12. Apparatus as defined in claim 1, wherein said conductor support member contains an inspection bore (24) that is arranged opposite said knife means when said conductor support means is in said second position.

13. Apparatus as defined in claim 12, wherein said terminal block member has a transverse wall (25) that is opposite said inspection bore when said conductor support member is in said second position.

* * * * *

UNITED STATES PATENT AND TRADEMARK OFFICE

CERTIFICATE OF CORRECTION

PATENT NO. : 6,120,315

DATED : September 19, 2000

INVENTOR(S) : Gaertner, et al.

It is certified that error appears in the above-indentified patent and that said Letters Patent is hereby corrected as shown below:

In the heading, indicate the Assignee as being:

-- Weidmüller Interface GmbH & Co. --

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*